US006127636A

United States Patent [19]

Parvulescu et al.

[11] Patent Number: 6,127,636

[45] Date of Patent: Oct. 3, 2000

[54] ROTARY SWITCH WITH DIRECTION-OF-ROTATION OUTPUT

[75] Inventors: Adrian Parvulescu, Fish's Eddy, N.Y.; Sophie Klym, Lincoln Park; Andrew Todd Zidel, Hawthorne, both of N.J.

[73] Assignees: Sony Corporation, Tokyo, Japan; Sony Electronics, Inc., Park Ridge, N.J.

[21] Appl. No.: 08/795,320

[22] Filed: Feb. 3, 1997

[51] Int. Cl.[7] ..... H01H 19/14

[52] U.S. Cl. ..... 200/11 R; 200/11 TW

[58] Field of Search ..... 200/11 TW, 11 R, 200/294, 296, 316, 16 R, 17 R; 368/187, 321

[56] References Cited

U.S. PATENT DOCUMENTS

| | | | |
|---|---|---|---|
| 3,005,881 | 10/1961 | Ellsworth | 200/11 TW |
| 3,691,326 | 9/1972 | Grossman et al. | 200/11 TW |
| 4,190,749 | 2/1980 | Erickson et al. | 200/11 TW |
| 4,449,832 | 5/1984 | Kammerer | 368/187 |
| 4,816,623 | 3/1989 | Huang | 200/11 R |

*Primary Examiner*—Khanh Dang
*Attorney, Agent, or Firm*—Rader, Fiashman & Grauer; Ronald P. Kananen

[57] ABSTRACT

A rotary switch with direction-of-rotation output includes a thumbwheel (12), a first reduced-diameter ratchet wheel (14), a second reduced-diameter ratchet wheel (16), and a mounting shaft (18) upon which the thumbwheel (12), ratchet wheel (14), and ratchet wheel (16) are mounted in side-by-side frictionally engaged relationship. The ratchet wheel (14) and the ratchet wheel (16) cooperate with respective pawls (24)(30) so that the ratchet wheel (14) is constrained for rotation in one direction only about the shaft (18), and the ratchet wheel (16) is constrained for rotation in the other direction only about the shaft (18). The thumbwheel (12) is in frictional engagement with the ratchet wheel (14) and the ratchet wheel (16) so that rotation of the thumbwheel (12) will cause one of the two ratchet wheels to rotate. Normally closed electrical switches (44)(46) are mechanically connected to the respective pawls (24)(30) so that rotation of the thumbwheel (12) will cause one switch or the other to open and close to thereby determine the direction-of-rotation of the thumbwheel (12).

18 Claims, 2 Drawing Sheets

ROTARY SWITCH WITH DIRECTION-OF-ROTATION OUTPUT

BACKGROUND OF THE INVENTION

The present invention relates to a rotary switch with direction-of-rotation output for use in electronic equipment.

One of the trends in portable electronic equipment, particularly cellular telephones, is to decrease the overall size of the device while increasing functionality. For example, the size of cellular telephones has decreased significantly from relatively large handheld units to devices no larger than a common pager while the number of functions that can be performed has increased dramatically. One problem associated with the reduced physical size involves engineering the user interface so that all the functions can be accessed in a reasonably efficient way. In addition to various keypad-type switches, rotary thumbwheel/push-button switches have been used. With a thumbwheel switch, a user merely rotates the thumbwheel in one direction or the other to call-up successive screen displays (i.e., a menu) and then pushes the thumbwheel along its axis of rotation to call a particular function presented on the screen. These thumbwheel/push-button switches offer substantial functionality while allowing one-hand operation of the device.

In a known switch of this type, the thumbwheel is connected to two sets of make/break switch contacts so that rotation of the thumbwheel will cause the two sets of switch contacts to open and close with one contact set leading or trailing the other by a selected phase difference (i.e., 90 degrees) as a function of the direction of rotation. Because the phase difference between the two switch outputs determines the direction of rotation, a program-controlled microprocessor must effect a quadrature analysis of the switch outputs to determine direction of rotation.

As can be appreciated, the use of a microprocessor dedicated to determining the direction of thumbwheel rotation results in a relatively expensive device.

SUMMARY OF THE INVENTION

In view of the above, it is an object of the present invention, among others, to provide a rotary switch with direction-of-rotation output suitable for use in electronic devices such as cellular telephones.

It is another object of the present invention to provide a rotary switch with direction-of-rotation output that is simpler and less expensive than prior devices having a similar function.

In view of these objects, and others, the present invention provides a rotary switch with direction-of-rotation output that includes a rotatably mounted user-operable thumbwheel and uni-directional mechanisms in frictional engagement with the thumbwheel. One of the uni-directional mechanisms rotates in a first direction when the thumbwheel is rotated in the first direction and the other uni-directional mechanism rotates in the other direction when the thumbwheel is rotated in the other direction. Each uni-directional mechanism is coupled to a respective switch so that a switched output corresponding to the direction of rotation is provided.

The preferred embodiment includes first and second ratchet/pawl assemblies rotatably mounted on a shaft on the opposite sides of and in frictional engagement with a user-operable thumbwheel. Rotation of the thumbwheel in a first direction will cause one of the ratchet/pawl assemblies to actuate while rotation of the thumbwheel in the other direction will cause the other of the ratchet/pawl assemblies to rotate. Electrical switches are connected to the pawls of each ratchet/pawl assembly and provide a switch output in response to movement of the respective pawl. Additionally, the thumbwheel can be translated axially a selected distance along the mounting shaft to actuate one or more additional switching devices.

The present invention advantageously provides a rotary switch with direction-of-rotation output that is simpler and less costly than prior devices while maintaining desired functionality.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
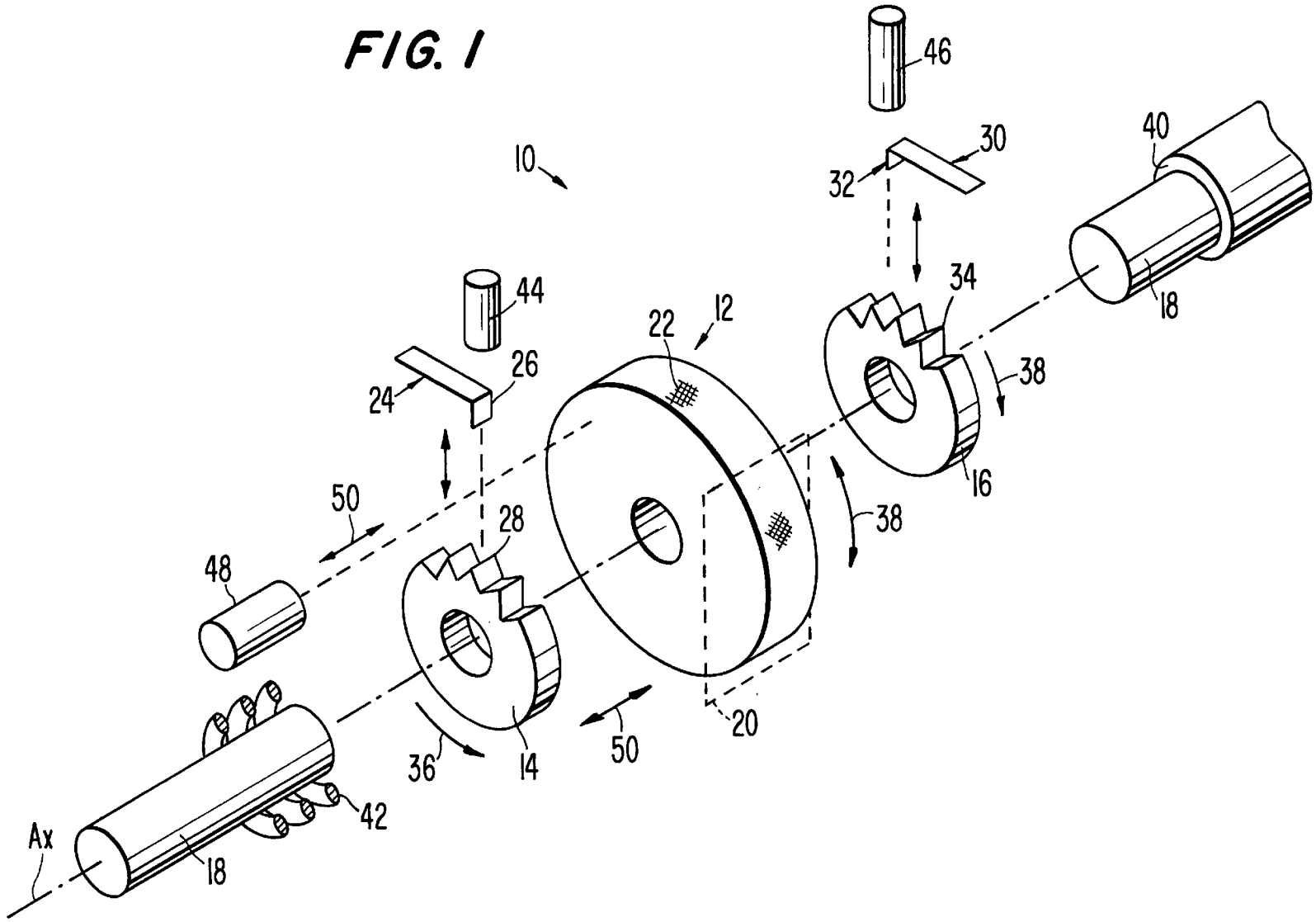
FIG. 1 is an exploded perspective view of selected components of a rotary switch in accordance with the present invention.
Figure 2:
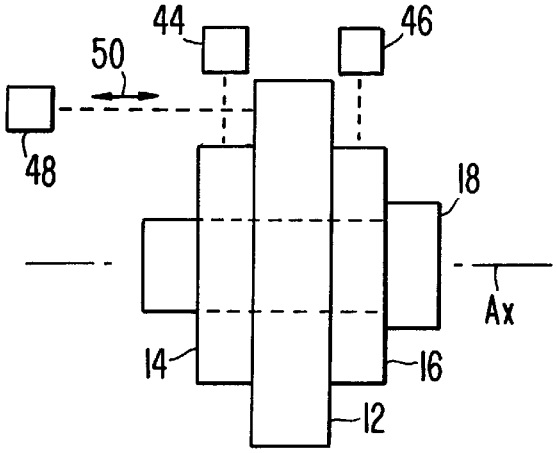
FIG. 2 is an elevational view of the components of FIG. 1 in their assembled positions.

A rotary switch with a direction-of-rotation output in accordance with the present invention is shown in exploded perspective in FIG. 1 and designated generally therein by the reference character 10. As shown, the rotary switch 10 includes a thumbwheel 12, a first reduced-diameter ratchet wheel 14, a second reduced-diameter ratchet wheel 16, and a mounting shaft 18. As shown in FIG. 2, the thumbwheel 12, ratchet wheel 14, and ratchet wheel 16 are mounted on the shaft 18 is a contiguous, side-by-side relationship on a common axis $A_x$. As explained below, the thumbwheel 12, ratchet wheel 14, and ratchet wheel 16 are mounted on the shaft 18 for independent rotation relative to one another and for sliding movement along the shaft 18.

The thumbwheel 12 is designed to have a portion thereof extending through an appropriately sized aperture (shown in dotted-line illustration in FIG. 1) in the panel or housing of an electronic device, such as the housing of a portable cellular telephone. Since the thumbwheel 12 (and its connected parts) are designed for sliding movement along the shaft 18, the side-to-side dimension of the aperture 20 must be wide enough to accommodate the lateral motion of the thumbwheel 12. As shown, the thumbwheel 12 is desirably provided with knurling 22 or ridges to assure ease of operation by the user.

Figure 3:
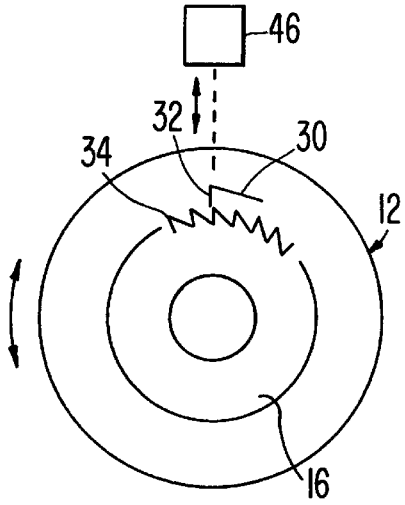
FIG. 3 is a side view of the components shown in FIG. 2.

The ratchet wheel 14 and the ratchet wheel 16 are of similar design and, as best shown in the side view of FIG. 3, include a plurality of equispaced teeth (only a few of which are shown). A pawl 24 having a tip 26 is resiliently biased by a spring (not shown) into operative engagement with the teeth 28 of the ratchet wheel 14, and, similarly, a pawl 30 having a tip 32 is resiliently biased into operative engagement with the teeth 34 of the ratchet wheel 16. As is known in the art, the ratchet/pawl combination operates to allow one-way or unidirectional rotation of the ratchet wheel while arresting any counter rotation. As the ratchet wheel rotates in the permitted direction, the tip of its pawl will follow the rising and falling contour of the teeth and sequentially move into and out of engagement with the successive teeth on the ratchet wheel.

In accordance with the invention and as best seen in FIG. 1, the ratchet wheel 14 is mounted on the shaft 18 on one side of the thumbwheel 12 so that rotation is allowed only in a first direction by its pawl 24, as indicated by the arrow 36, and the ratchet wheel 16 is mounted on the shaft 18 on the opposite side of the thumbwheel 12 so that rotation is allowed only in an opposite direction by its pawl 30, as indicated by the arrow 38. The three components, the thumbwheel 12, ratchet wheel 14, and ratchet wheel 16 are resiliently biased together so that there is sufficient frictional drag between the components so that rotation of the thumbwheel 12, depending upon the direction of rotation, will cause one or the other of the frictionally engaged ratchet wheel 14 or ratchet wheel 16 to rotate therewith. The thumbwheel 12, ratchet wheel 14, and ratchet wheel 16 may be biased together against a shoulder 40 on the shaft 18 by a compressed helical spring 42 or, for example, a resilient felt washer (not shown). More specifically, the frictional relationship between the thumbwheel 12, ratchet wheel 14, and ratchet wheel 16 is such that rotation of the thumbwheel 12 in the counterclockwise direction in FIG. 1 will cause the ratchet wheel 14 to rotate in the same counterclockwise direction. While the ratchet wheel 16 will attempt to also rotate counterclockwise, its movement in that direction will be arrested by its pawl 30. Conversely, rotation of the thumbwheel 12 in the clockwise direction in FIG. 1 will cause the ratchet wheel 16 to rotate in the same clockwise direction and rotation of the ratchet wheel 14 will be arrested by its pawl 24.

As shown in FIG. 1 and FIG. 3, a switch 44 is connected to and operated by motion of the pawl 24. Another electrical switch 46 is connected to and operated by motion of the pawl 30. The two switches may take the form, for example, of a simple normally closed (NC) make/break contact pair. If desired, the pawls can be fabricated from an electrically conductive metal and can constitute one of the contacts of each contact pair. In the case of the configuration of FIG. 3, rotation of the thumbwheel 12 in a first direction will also rotate the frictionally engaged ratchet wheel 14 to cause its pawl 24 to move between two positions as its tip 26 follows the contours of the teeth 28. As a consequence, the electrical contacts of the switch 44 will successively make and break contact. In a similar manner, rotation of the thumbwheel 12 in the opposite direction will rotate the frictionally engaged ratchet wheel 16 to cause its pawl 30 to move between two positions as its tip 26 follows the contours of the teeth 34. As a consequence, the electrical contacts of the switch 46 will successively make and break contact.

By placing the switches 44 and 46 in respective series circuits with a power source (not shown), the direction-of-rotation of the thumbwheel 12 can be easily determined.

Figure 4:
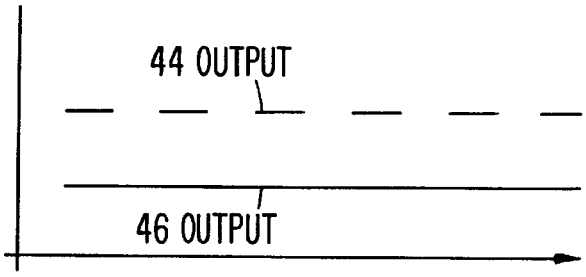
FIG. 4 is a graph illustrating the electrical output with time of the rotary switch when rotated in a first direction.
Figure 5:
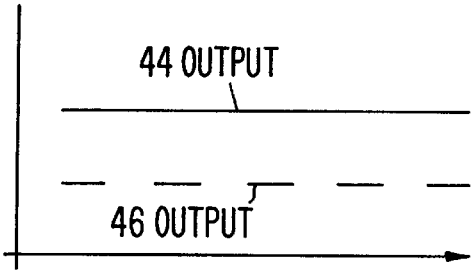
FIG. 5 is a graph, similar to FIG. 4, illustrating the output rotary switch when rotated in a second direction opposite from the first direction.

As shown in FIG. 4, the current flow through the switch 44 is periodically interrupted while the current flow through the switch 46 is uninterrupted as the thumbwheel 12 is rotated in a first direction. Conversely and as shown in FIG. 5, the current flow through switch 46 is periodically interrupted while the current flow through switch 44 is uninterrupted as the thumbwheel 12 is rotated in the second direction.

A third electrical switch 48 is mounted to the side of the thumbwheel 12 (see FIG. 1 and FIG. 2). Since the thumbwheel 12 is also mounted on the shaft 18 for relative sliding motion (i.e., to the left in FIG. 1 as indicated by arrow 50), sliding movement of the thumbwheel 12 to the left in FIG. 1 will cause selective actuation of the switch 48. While only one laterally positioned switch, switch 48, has been shown in the figures, other laterally positioned switches may also be used. For example, a normally closed (NC) switch (not shown) can be mounted on the side of the thumbwheel 12 opposite that of the switch 48; as the thumbwheel 12 is moved to the left in FIG. 1, the normally closed switch will open as the switch 48 is actuated.

The preferred embodiment of the present invention utilizes make/break contact switches to indicate which of the two ratchet wheels is undergoing rotation by movement of the thumbwheel 12. As can be appreciated, other switching arrangements are equally desirable. For example, Hall-effect switches can be used or electro-optic switching can be used in which light transmitted between a light-emitting diode (LED) and a photodiode or phototransistor is periodically interrupted by a shutter/vane attached to the respective pawl. Similarly, a shutter-disc having slots or apertures formed on a circumferential margin can be attached to each ratchet wheel to periodically interrupt an optical source and its cooperating detector in a photocoupler.

No special materials or surface treatments are indicated for the surface-to-surface contact of the frictionally engaged thumbwheel and the ratchet wheels.

The resilient biasing force should be large enough to insure sufficient frictional engagement throughout the operating life of the rotary switch.

Since the circuit interruption pulses shown in both FIG. 4 and FIG. 5 are a function of the rotary velocity of the thumbwheel 12, the rotary velocity of the thumbwheel 12 can also be determined as a function of time.

As will be apparent to those skilled in the art, various changes and modifications may be made to the illustrated rotary switch with direction-of-rotation output of the present invention without departing from the spirit and scope of the invention as determined in the appended claims and their legal equivalent.

What is claimed is:

1. A rotary switch with direction-of-rotation output comprising:

a user-operable member mounted for rotation about an axis in a first and in a second direction;

a first and a second uni-directional rotary mechanism in operative engagement with said user-operable member so that movement of said user-operable member in a first direction causes corresponding movement of one of said first and second uni-directional rotary mechanisms and movement of said user-operable member in a second direction causes a corresponding movement of the second of said first and second uni-directional rotary mechanisms; and a first electrical switch in operative engagement with said first uni-directional rotary mechanisms and a second electrical switch in operative engagement with said second uni-directional rotary mechanism, movement of either one of said uni-directional rotary mechanisms in response to a corresponding movement of said user-operable member causing the respective switch to actuate between its switching states to provide a direction-of-rotation output;

wherein each of said first and second uni-directional mechanisms comprise a ratchet-and-pawl mechanism; and wherein said first and said second electrical switches are operatively connected to the pawls of their respective ratchet-and-pawl mechanisms.

2. The rotary switch with direction-of-rotation output of claim 1, wherein said user-operable member comprises a discoidal member mounted on a shaft for rotation about said axis.

3. The rotary switch with direction-of-rotation output of claim 2, wherein each of said ratchet-and-pawl mechanisms is in frictional engagement with said discoidal member.

4. A rotary switch with direction-of-rotation output comprising:

a user-operable disc mounted for rotation about an axis;

a first ratchet mounted for rotation about the axis and having a pawl constraining said first ratchet for rotation about the axis in a first direction;

a second ratchet mounted for rotation about the axis and having a pawl constraining said second ratchet for rotation about the axis in a second direction;

said first and second ratchets in frictional engagement with said disc, said first ratchet rotated in the first direction by movement of the disc in the first direction and said second ratchet rotated in the second direction by movement of the disc in the second direction; and a first switch operatively connected to said first ratchet and a second switch operatively connected to said second ratchet, each of said switches responsive to movement of their respective ratchets to provide a switching output thereof indicative of the direction of rotation of said user-operable disc.

5. The rotary switch with direction-of-rotation output of claim 4, further comprising a shaft upon which said user-operable disc is mounted for rotation about said axis.

6. The rotary switch with direction-of-rotation output of claim 5, wherein said first and second ratchets are mounted upon said shaft for rotation about said axis.

7. The rotary switch with direction-of-rotation output of claim 6, wherein said first and second ratchets are mounted upon said shaft on opposite sides of said disc and are in frictional engagement therewith.

8. The rotary switch with direction-of-rotation output of claim 7, further comprising means for resiliently biasing said first and second ratchets and said disc into frictional engagement with one another.

9. The rotary switch with direction-of-rotation output of claim 7, wherein at least one of said first and second ratchets and said disc are mounted on said shaft for translation a long said axis.

10. The rotary switch with direction-of-rotation output of claim 9, further comprising a third electrical switch actuated by translation of at least said disc along said axis.

11. A rotary switch with direction-of-rotation output comprising:

a user-operable thumbwheel mounted on a shaft for rotation about a longitudinal axis;

a first ratchet wheel mounted on said shaft on one side of said thumbwheel and in frictional engagement therewith;

a first pawl in operative engagement with said first ratchet wheel and constraining said first ratchet wheel for rotation in a first direction about said shaft;

a second ratchet wheel mounted on said shaft on the other side of said thumbwheel and in frictional engagement therewith;

a second pawl in operative engagement with said second ratchet wheel and constraining said second ratchet wheel for rotation in a second direction about said shaft; and a first switch operatively connected to said first pawl and a second switch connected to said second pawl, each of said switches responsive to movement of their respective ratchet wheels to provide a switching output thereof indicative of the direction of rotation of said disc.

12. The rotary switch with direction-of-rotation output of claim 11, further comprising means for resiliently biasing said first and second ratchet wheels into frictional engagement with said thumbwheel.

13. The rotary switch with direction-of-rotation output of claim 12, wherein said means for resiliently biasing comprises a spring.

14. The rotary switch with direction-of-rotation output of claim 11, wherein said thumbwheel is axially translatable a selected distance along said axis.

15. The rotary switch with direction-of-rotation output of claim 14, a third switch operatively engagable by said thumbwheel upon axial translation thereof along said axis.

16. A wireless telephone unit with a user input device, the unit comprising:

an opening in a housing of said wireless telephone unit;

a rotating user-operable member mounted for rotation about an axis in a first and in a second direction, wherein a portion of said user-operable member extends through said opening;

a first and a second uni-directional rotary mechanism in operative engagement with said user-operable member so that movement of said user-operable member in a first direction causes corresponding movement of one of said first and second uni-directional rotary mechanisms and movement of said user-operable member in a second direction causes a corresponding movement of the other of said first and second uni-directional rotary mechanisms; and a first electrical switch in operative engagement with said first uni-directional rotary mechanisms and a second electrical switch in operative engagement with said second uni-directional rotary mechanism, movement of either one of said uni-directional rotary mechanisms in response to a corresponding movement of said user-operable member causing the respective switch to actuate between its switching states to provide a direction-of-rotation output;

wherein said user input device comprises said user-operable member, said first and second uni-directional rotatry mechanisms, and said first and second electrical switches.

17. The wireless telephone unit with a user input device of claim 16, wherein each of said first and second uni-directional mechanisms comprise a ratchet-and-pawl mechanism.

18. The wireless telephone unit with a user input device of claim 17;

wherein said first and said second electrical switches are operatively connected to the pawls of their respective ratchet-and-pawl mechanisms.

* * * * *